United States Patent [19]

Fritz

[11] 4,139,111

[45] Feb. 13, 1979

[54] MATERIALS HANDLING APPARATUS

[76] Inventor: Alton L. Fritz, 12121 N. 83rd Ave., Peoria, Ariz. 85345

[21] Appl. No.: 838,801

[22] Filed: Oct. 3, 1977

[51] Int. Cl.[2] ..... B66F 9/22

[52] U.S. Cl. ..... 214/674; 214/672

[58] Field of Search ..... 214/670, 672, 674, DIG. 5, 214/DIG. 12; 187/9 R

[56] References Cited

U.S. PATENT DOCUMENTS

| | | | |
|---|---|---|---|
| 2,921,704 | 1/1960 | Schultz | 214/674 |
| 3,272,287 | 9/1966 | Easton | 214/672 X |

*Primary Examiner*—Robert G. Sheridan

*Attorney, Agent, or Firm*—Herbert E. Haynes, Jr.

[57] ABSTRACT

A material handling apparatus including a forklift assembly for attachment to a hanger bracket carried on the front end of an automotive vehicle of the type which may travel over roads and highways. The forklift assembly and hanger bracket are both especially configured for demountable attachment of the forklift assembly, and to allow pivotal movement thereof relative to the hanger bracket so that tilting of the forklift assembly may be accomplished without the vehicle's close proximity restricting such movements.

12 Claims, 8 Drawing Figures

MATERIALS HANDLING APPARATUS

BACKGROUND OF THE INVENTION

1. Field of the Invention

This invention relates to material handling mechanisms and more particularly to an elevating type of material handling apparatus for demountable connection to the front end of an automotive road vehicle.

2. Description of the Prior Art

The loading and unloading of heavy materials on trucks, trailers and the like usually does not present a problem at a warehouse or other more or less permanent locations where such loading is often and frequently accomplished, in that conventional forklift trucks, conveyors and similar equipment is most often available at those sites. However, such is not the case in remote locations where loading and/or unloading is infrequently accomplished. Thus, at those remote locations the material handling is often accomplished by hand unless special arrangements are made to transport conventional material handling vehicles or equipment to those sites.

This material handling problem has long been recognized, and to the best of my knowledge, no completely satisfactory solution has yet been proposed.

For example, U.S. Pat. Nos. 2,910,203 and 3,186,571 both disclose forklift mechanisms mounted on the frame which extends rearwardly from the tractor cab of a tractor-trailer type of road vehicle. Those forklift mechanisms are very complex due to the fact that they are mounted at the same location where the trailer is coupled to the tractor. In addition to the complexity, the need for decoupling the tractor from the trailer prior to utilization of the forklift mechanism has contributed to the lack of commercial acceptance of those mechanisms.

In an attempt to provide a solution to this material handling problem, it was suggested in U.S. Pat. No. 3,272,287, that a forklift apparatus be carried on the front end of a tractor of a tractor-trailer road vehicle. This forklift apparatus is affixed between a pair of brackets which extend forwardly from the vehicle's frame, and is pivotably movable about an axis extending between those brackets so that the forklift may be tilted as required to properly level loads being elevated thereby. This prior art vehicular mounted forklift has several disadvantages and drawbacks. In the first place, the mounting technique employed is such that the forklift apparatus is, for all intents and purposes, an integral part of the vehicle and thus is most practically carried even when not needed. A second drawback results from the need to decouple the tractor from the trailer in order to handle materials in the trailer. Such decoupling is also advisable when the forklift mechanism is to be used to handle materials in another vehicle in that sufficient maneuverability is lacking when the tractor is coupled to a trailer. A further drawback exists in this specific prior art device, in that tilting of the forklift is accomplished by pivoting it about the previously described axis which is relatively low with respect to the height of the vehicle and such a low pivot axis seriously limits tilting movements of the forklift toward the vehicle due to the close proximity of the hood, radiator, and other front end components of the vehicle. A still further drawback of this prior art device is the relatively tall mast, or vertically stationary frame member in which the elevating equipment is mounted with that height constituting a visibility problem if the forklift apparatus is mounted on a vehicle other than one that is as tall as the trailer-tractor vehicle shown in this previously referenced U.S. Patent.

Therefore, a need exists for a materials handling mechanism for demountable attachment to an automotive road vehicle which overcomes some of the problems and shortcomings of the prior art.

SUMMARY OF THE INVENTION

In accordance with the present invention, a new and improved materials handling apparatus is disclosed as including a forklift assembly for demountable attachment to a hanger bracket fixedly carried on the front end of an automotive road vehicle. The hanger bracket has a spaced pair of side plates affixed to the vehicle's frame and interconnected by suitable crossbars. The side plates are configured so as to extend forwardly from the vehicle's frame and upwardly in front of the vehicle's front end components. The plates are connected at their upwardly and forwardly disposed ends with one of the crossbars which is disposed approximately at the midpoint of the height dimension of the vehicle's front end. The forklift assembly has a vertically stationary frame member which carries the vertically movable components of the assembly. The stationary frame has releasable clamps for demountably and pivotably coupling the forklift assembly to the upper forward crossbar of the hanger bracket, and is further provided with extending rollers on the lower end of the stationary frame member which engage load bearing arcuate rails carried on the side plates of the hanger bracket. Tilting of the forklift assembly is accomplished by a hydraulic cylinder affixed on one end thereof to the lower end of the stationary frame member and is demountably connected on its other end to another hanger bracket crossbar which is carried between the side plates of the hanger bracket at the rearwardly and downwardly disposed ends thereof.

By mounting the forklift assembly to the upper forward crossbar of the hanger bracket as described above, that crossbar serves as a pivot axis, and due to the midpoint positioning thereof, the forklift assembly may be tilted a considerable amount relative to the road vehicle without moving into contact with the front end components thereof.

In the preferred embodiment the forklift assembly is provided with first and second stage hydraulically operated vertically movable frame members carried in a telescoping manner in the stationary frame member, and is provided with a vertically movable carriage having the usual pair of forklift blades mounted thereon.

The vertically stationary frame member and the first and second stage vertically movable frame members are each of a minimum height dimension so that when those frame members are in the retracted position they will not present a visibility problem to the driver of the vehicle which is carrying the material handling apparatus of the present invention.

It is also preferred that the forklift assembly be self-contained for quick disconnect purposes, and this is accomplished by mounting the necessary hydraulic equipment on the stationary frame member.

Accordingly, it is an object of the present invention to provide a new and improved material handling apparatus.

Another object of the present invention is to provide a new and improved material handling apparatus for demountable attachment to the front end of an automotive road vehicle.

Another object of the present invention is to provide a new and improved material handling apparatus including a forklift assembly for attachment to a hanger bracket affixed on the front end of an automotive road vehicle.

Another object of the present invention is to provide a new and improved material handling apparatus of the above described character with the hanger bracket and the forklift assembly being configured for demountable attachment of the forklift assembly to the hanger bracket.

Another object of the present invention is to provide a new and useful material handling apparatus of the above described character in which the forklift assembly is pivotably movable about a pivot crossbar of the hanger bracket with the pivot crossbar being disposed to provide a maximum amount of tilting movement of the forklift assembly relative to the automotive road vehicle.

Another object of the present invention is to provide a new and improved materials handling apparatus including a forklift assembly which is self-contained for quick and simple demountable attachment to a special hanger bracket fixedly mounted on the front end of an automotive road vehicle.

Still another object of the present invention is to provide a new and improved material handling apparatus of the above described character in which the forklift assembly is configured with a vertically stationary frame member in which a first and a second vertically movable frame members are telescopically extensibly mounted with each of those frame members having a minimum height dimension to present a low profile when in the retracted position so as not to provide a visibility problem when carried on the automotive road vehicle.

The foregoing, and other objects of the present invention, as well as the invention itself, may be more fully understood from the following description when read in conjunction with the accompanying drawings.

DESCRIPTION OF THE PREFERRED EMBODIMENT

Figure 1:
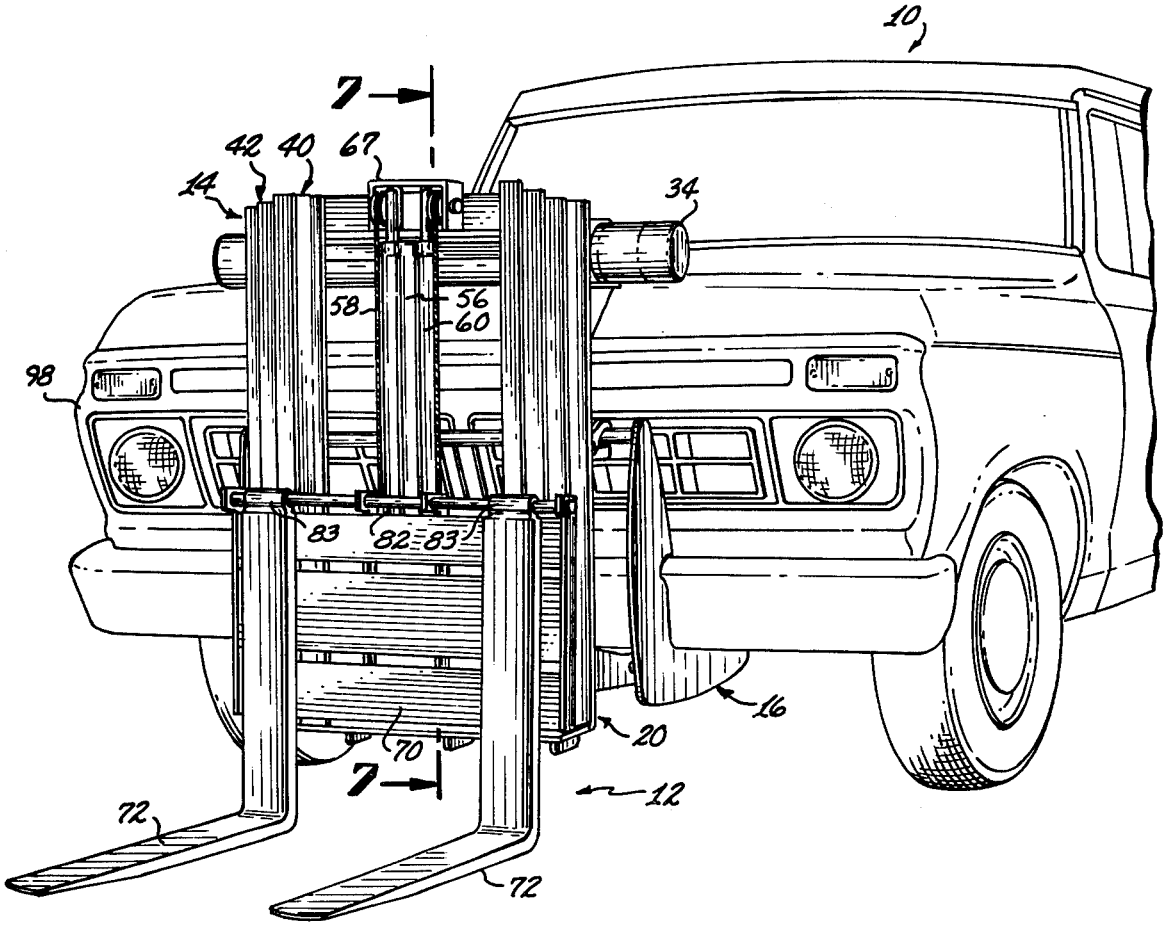
FIG. 1 is a fragmentary perspective view of a typical type of automotive road vehicle having the material handling apparatus of the present invention mounted thereon.

Referring more particularly to the drawings, FIG. 1 shows a fragmentary portion of an automotive road vehicle which is indicated generally by the reference numeral 10. The road vehicle 10 is shown as being a light duty truck of the type commonly referred to as a pickup truck. It should, however, be understood that that specific type of vehicle shown is not intended as a limitation of the present invention, as the instant apparatus can be used on other road vehicles such as heavy duty trucks, automobiles, vans, and the like.

FIG. 1 also shows the material handling apparatus of the present invention, which is indicated in its entirety by the reference numeral 12, as being mounted on the front end of the road vehicle 10. As will hereinafter be described in detail, the material handling apparatus 12 includes a forklift assembly and a hanger bracket which are indicated generally by the reference numerals 14 and 16, respectively.

It will be understood that the forklift assembly may deviate in design details from the specific and preferred configuration shown, as the forklift art per se is highly developed, and any of several well known designs may be considered as functional equivalents. However, the specifically shown forklift assembly 14 provides advantages which will be hereinafter described.

Figure 2:
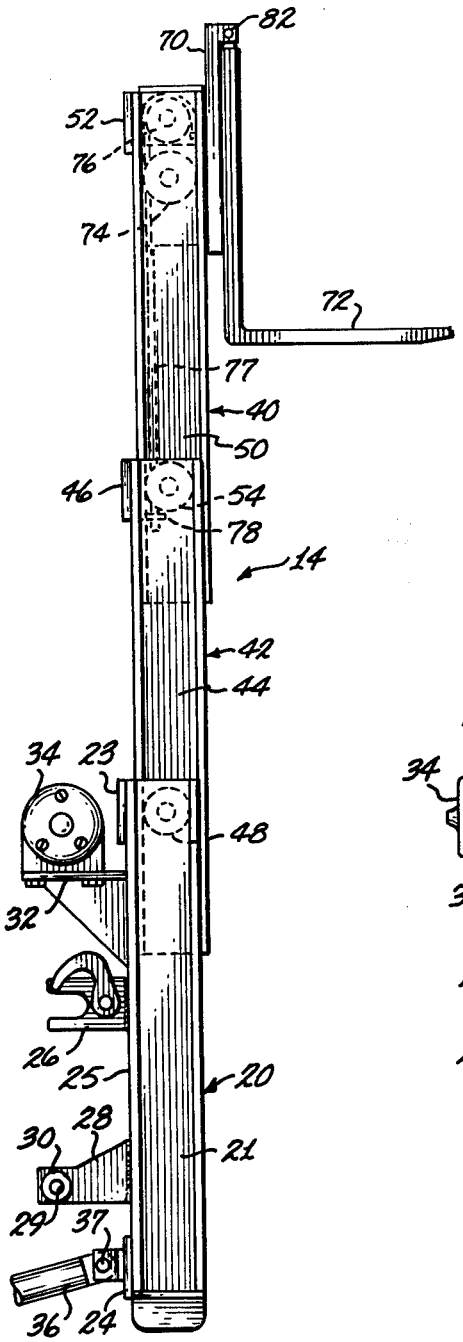
FIG. 2 is a side elevational view illustrating the upwardly extended position of the forklift assembly which is part of the material handling apparatus of the present invention.
Figure 3:
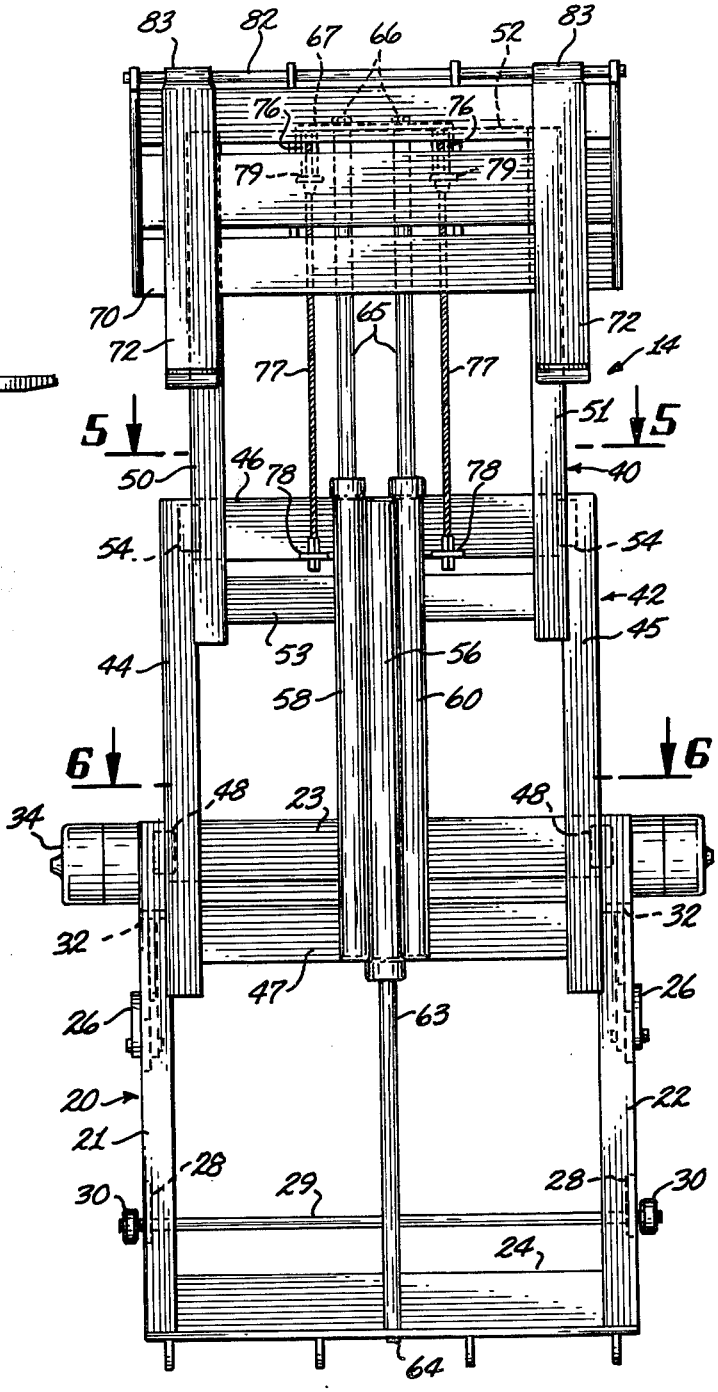
FIG. 3 is a front elevational view of the forklift assembly shown in FIG. 2.
Figure 4:
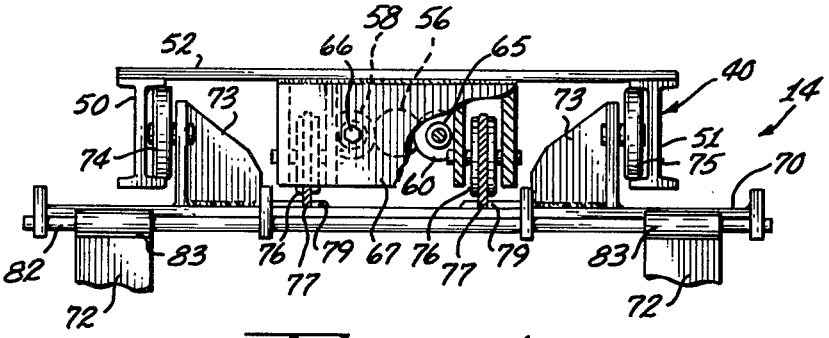
FIG. 4 is an enlarged fragmentary plan view of the forklift assembly with portions thereof broken away to show the various features thereof.

As seen best in FIGS. 2 and 3, the forklift assembly 14 is provided with a vertically stationary frame member 20 having a spaced pair of side rails 21 and 22 which are interconnected by transverse top and bottom plates 23 and 24. Each of the side rails 21 and 22 are formed with rearwardly facing flanges 25, i.e., they face the front of the road vehicle 10, and each of those flanges 25 has a rearwardly extending releasable clamp means 26 mounted substantially intermediate the opposite ends thereof. Each of the flanges 25 also carries a rearwardly extending plate 28 mounted adjacent the lower end thereof. A fixed axle 29 is mounted to extend between and through the plates 28 so that the opposite ends of the fixed axle 29 are disposed to rotatably support roller wheels 30 thereon. Adjacent the upper ends of each of the side rails 21 and 22, a rearwardly extending shelf 32 is mounted for supporting the hydraulic system 34 thereon or other suitable power supply means, which operates the forklift assembly 14 in accordance with techniques well known in the art. Intermediate the opposite ends of the transverse bottom plate 24 of the vertically stationary frame member 20, an extensible power means such as a hydraulic cylinder 36 is pivotably carried on a suitably supported pivot pin 37 so that the cylinder extends rearwardly from the stationary frame member 20.

Figure 7:
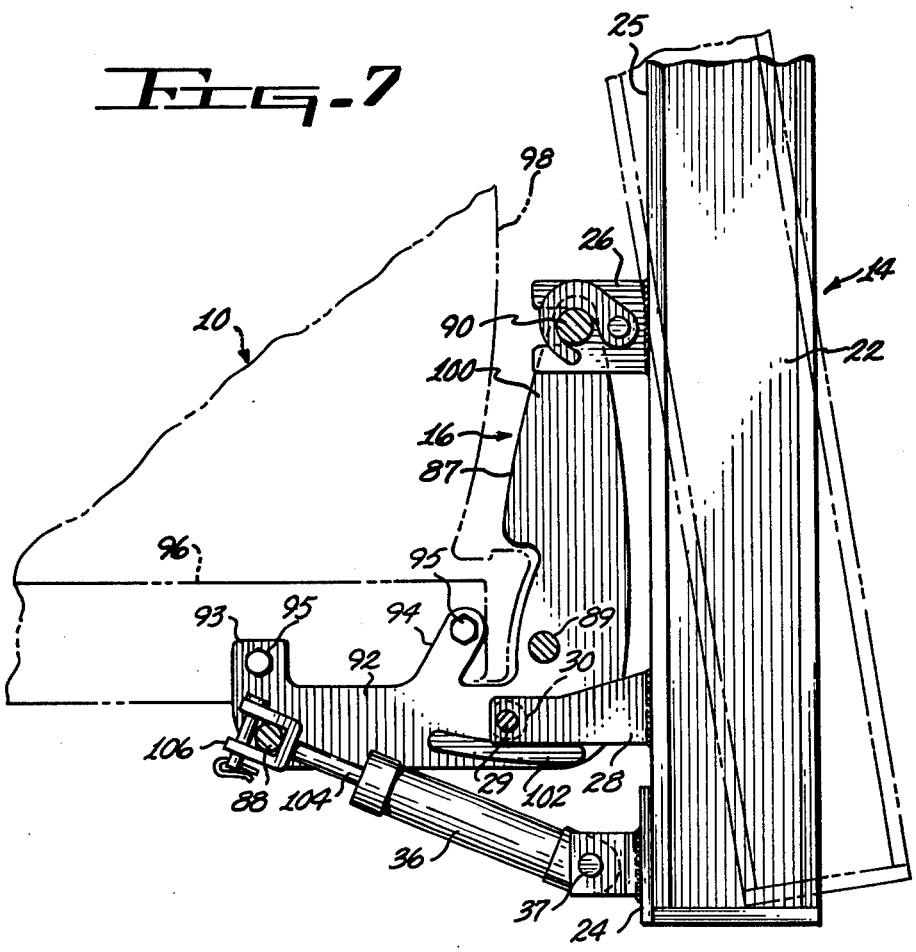
FIG. 7 is an enlarged fragmentary sectional view taken along the line 7—7 of FIG. 1.

The releasable clamp means 26, the rotatable roller wheels 30 and the hydraulic cylinder 36 are all connected to the hanger bracket 16 as shown in FIG. 7 and as will hereinafter be described in detail.

A first stage vertically movable frame member 40 and a second stage vertically movable frame member 42 are positioned between the side rails 21 and 22 of the vertically stationary frame member 20, and are vertically movable in a telescoping manner relative thereto as will be described.

The second stage vertically movable frame member 42 is provided with a spaced pair of side rails 44 and 45 which are interconnected by top and bottom transverse plates 46 and 47. The side rails 44 and 45 are spaced so that they nestingly fit between the side rails 21 and 22 of the stationary frame member 20 as seen best in FIG. 6. A roller wheel 48 is mounted on the inwardly facing surface of each of the side rails 21 and 22, and are adapted to rollingly engage the outwardly disposed surfaces of the side rails 44 and 45 in a manner which allows the second stage frame member 42 to be moved vertically relative to the stationary frame member 20.

The first stage vertically movable frame member 40 is likewise provided with a spaced pair of side rails 50 and 51 which are interconnected by top and bottom transverse plates 52 and 53. The side rails 50 and 51 are spaced so that they nestingly fit between the side rails 44 and 45 of the second stage vertically movable frame member 42 as seen best in FIG. 5. A roller wheel 54 is mounted on the inwardly facing surface of each of the side rails 44 and 45 and are adapted to rollingly engage the outwardly disposed surfaces of the side rails 50 and 51 in a manner which allows the first stage frame member 40 to be vertically movable relative to the second stage vertically movable frame member 42.

Figure 5:
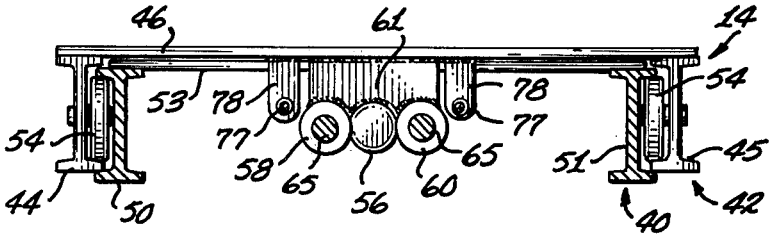
FIG. 5 is an enlarged sectional view taken on the line 5—5 of FIG. 3.
Figure 6:
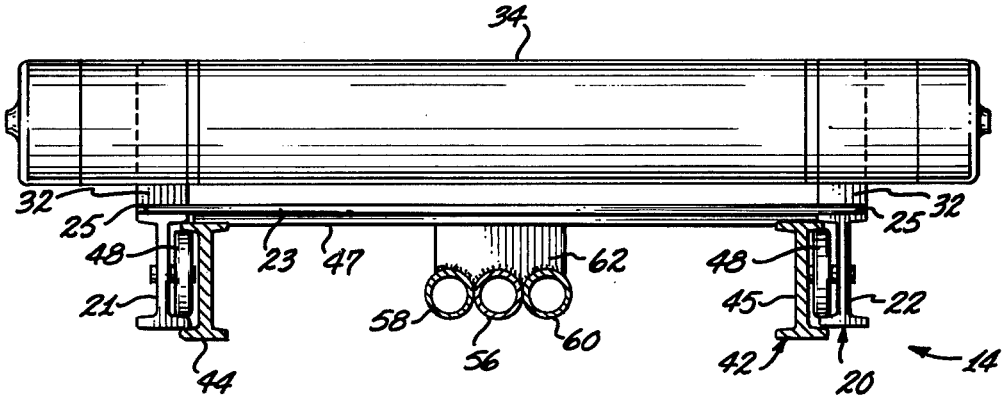
FIG. 6 is an enlarged sectional view taken on the line 6—6 of FIG. 3.

As seen best in FIGS. 3, 5, and 6, extensible power means in the form of a downwardly facing hydraulic cylinder 56 and a pair of upwardly facing hydraulic cylinders 58 and 60 are arranged in side by side relationship and are affixed such as by welding to upper and lower support plates 61 and 62 which respectively extend forwardly from the transverse plates 46 and 47 of the second stage vertically movable frame member 42. The downwardly facing hydraulic cylinder 56 has the usual extensible piston rod 63 which has its extending end fixedly attached such as at 64 to the vertically stationary frame member 20. The upwardly facing hydraulic cylinders 58 and 60 each have the usual extensible piston rods 65 with those rods having their extending ends fixedly attached such as at 66 to a bracket 67 which extends forwardly from the transverse top plate 52 of the first stage vertically movable frame member 40.

The forklift assembly 14 is provided with suitable controls (not shown) by which the hydraulic system 34 may be actuated to elevate the forklift mechanism 14 from the retracted position shown in FIG. 1 to the extended position shown in FIGS. 2 and 3. The elevating sequence occurs by first actuating the upwardly facing hydraulic cylinders 58 and 60 which causes the piston rods thereof to move to the extended positions as shown in FIG. 3. Such movement will cause the first stage movable frame member 40 to move vertically relative to the second stage vertically movable frame member 42. When that operation is completed, the hydraulic system 34 will automatically actuate the downwardly facing hydraulic cylinder 56 causing its piston rod 63 to move to the extended position shown in FIG. 3. This actuation of the downwardly facing hydraulic cylinder 56 will cause both the first and the second stage movable frame members 40 and 42 to move in unison vertically relative to the stationary frame member 20.

As shown in FIGS. 1, 2, 3 and 4, the forklift assembly 14 also includes a carriage 70 upon which a pair of forklift blades 72 are carried. The carriage 70 is a substantially planar structure having a pair of rearwardly extending brackets 73 upon which a pair of roller wheels 74 and 75 are mounted. The carriage 70 and the bracket 73 are configured so that the roller wheel 74 is in rolling engagement with the inwardly disposed surfaces of the side rail 50 of the first stage frame member 40. The other roller wheel 75 is similarly in engagement with the other side rail 51 of the first stage frame member 40. Thus, the carriage 70 and forklift blades 72 are vertically movable relative to the first stage frame member 40. This vertical movement of the carriage and forklift blades is accomplished by a cable pulley arrangement which is seen best in FIGS. 2 and 3. The previously described bracket 67, which extends forwardly from the top transverse plate 52 of the first stage frame member 40, has a pair of pulleys 76 rotatably carried thereon. A pair of cables 77 pass over the pulleys 76 and each are suitably affixed on one of their ends to lugs 78 projecting from the top transverse plate 46 of the second stage frame member 42. The opposite ends of each of the cables 77 are suitably affixed such as at 79 to the rearwardly facing surface of the carriage 70. In this manner, when the first stage vertically movable frame member 40 is being elevated, as previously described, the carriage 70 will automatically travel upwardly on the side rails 50 and 51 from the downwardly disposed position thereof shown in FIG. 1 to the upwardly disposed position seen in FIGS. 2 and 3.

The carriage 70 has an elongated rod 82 mounted on the top thereof to which the forklift blades 72 are attached by means of loop structures 83 formed on the blades. The loops 82 allow the blades to be laterally slidingly moved along the rod 82 so that the spacing between the blades can be adjusted as needed. Those same loops 83 allow the blades 72 to be pivoted about the rod 82 from the working position shown in FIG. 1 to a stored position (not shown) in which the normally forwardly extending portions of the blades will rest atop the forklift assembly 14 and extend rearwardly over the hood of the vehicle 10.

It will be seen in FIG. 1 that the height dimensions of the vertically stationary frame member 20, the first stage vertically movable frame member 40, and the second stage vertically movable frame member 42 are all approximately equal to the height dimension of the front end of the vehicle 10, i.e., from the ground to the top of the hood. In this manner when the forklift assembly 14 is in retracted position, it will not extend to any great extent into the field of vision of an operator of the vehicle. Since the apparatus of the present invention may be mounted on a variety of vehicles, it is important from a safety standpoint, that the height dimension of the frames 20, 40 and 42 are less than the height dimension from the ground to the windshield of the vehicle upon which the apparatus 12 is to be mounted and transported.

Figure 8:
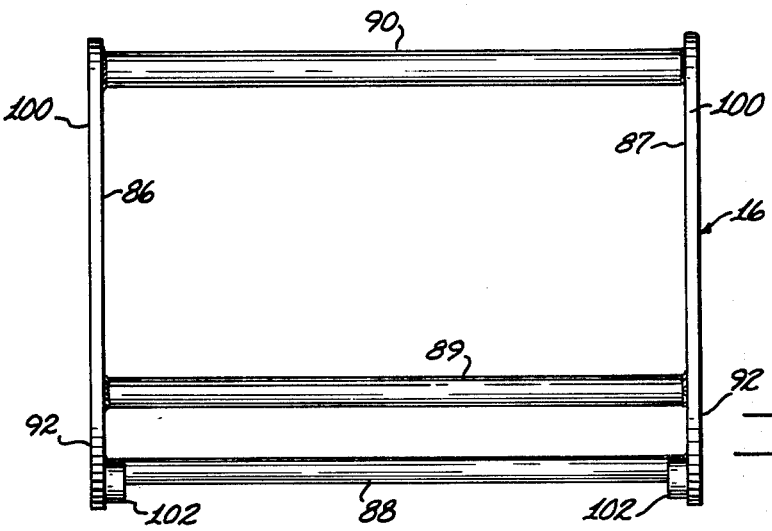
FIG. 8 is a front elevational view of the hanger bracket which forms part of the material handling apparatus of the present invention.

Reference is now made to FIGS. 7 and 8 wherein the hanger bracket 16 is best seen. The hanger bracket 16 includes an identical pair of spaced side plates 86 and 87 which are interconnected by a bottom or lower transverse crossbar 88, and intermediate transverse crossbar 89 and an upper transverse crossbar 90.

Since the side plates 86 and 87 are identical, it will be understood that the following description of the side plate 87 will also apply to the side plate 86.

The side plate 87 is seen to include a substantially horizontally disposed portion 92 having upstanding tabs 93 and 94 by which the plate 87 is affixed such as by suitable bolts 95 to the forwardly extending end of one of the rail members of the vehicle's frame 96. The bottom transverse crossbar 88 is affixed to the rearwardly extending end of the horizontally disposed portion 92 of the side plate 87 so that this crossbar is located below the vehicle's frame 96 and is set back from the front end 98 of the vehicle 10.

The side plate 87 also has a substantially vertically disposed portion 100 which is integral with the horizontal portion 92 and extends upwardly from the forward end thereof. The intermediate transverse crossbar 89 is positioned proximate the junction or corner formed by the horizontally and vertically disposed portions 92 and 100, respectively, of the side plate 87. The upper transverse crossbar 90 is affixed to the uppermost end of the vertically extending portion 100 of the side plate 87 so that this crossbar 90 is disposed forwardly of the vehicle's front end at a point which is approximately the midpoint of the height dimension of the vehicle's front end 98.

Each of the side plates 86 and 87 is provided with load bearing means in the form of an arcuate rail 102 on its inwardly facing surface so that when the forklift assembly 14 is demountably coupled to the hanger bracket 16, by connection of the releasable clamp means 26 to the upper transverse crossbar 90, the roller wheels 30 of the forklift assembly 14 will be in movable engagement with the load bearing arcuate rails 102.

The upper transverse rail 90 of the hanger bracket 16 acts as an axis about which the forklift assembly is pivotably movable as will be described. The pivot movement of the forklift assembly 14 is required for load leveling purposes and is accomplished by means of the hydraulic cylinder 36 which, as previously described, is pivotably affixed on one of its ends to the forklift assembly 14 by means of the pivot pin 37. The hydraulic cylinder 36 is provided with the usual extensible piston rod 104 which has a clevis member 106 on its extending end. The clevis member 106 is straddlingly positioned on the lower transverse crossbar 88 of the hanger bracket 16 when the forklift assembly 14 is demountably coupled thereto. Therefore, tilting of the forklift assembly 14 is accomplished by appropriately extending or retracting the piston rod 104 of the hydraulic cylinder 36 causing it to pivot about the upper transverse crossbar 90 such as shown in phantom and solid lines in FIG. 7.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operating requirements without departing from those principles.

For example, the hydraulic system 34 which is shown as being mounted on the forklift assembly 14, constitutes the preferred embodiment, in that its only connection with the vehicle will be electrical for operation of the hydraulic system pumps. However, it will be obvious that even the electrical connection could be eliminated by providing the material handling apparatus 12 of the present invention, with a battery (not shown). Further, it will be obvious that a vehicle mounted hydraulic system (not shown) could be employed.

The appended claims are therefore intended to cover and embrace any such modifications within the limits only of the true spirit and scope of the invention.

What I claim is:

1. A material handling apparatus for demountable connection to the front end of an automotive road vehicle having a frame upon which the vehicles body is supported, said material handling apparatus comprising:

(a) a hanger bracket for attachment to the front end of the frame of the vehicle and configured to extend forwardly and upwardly in front of the vehicle;

(b) a forklift assembly having a vertically stationary frame member disposed in a substantially upright position;

(c) releasable clamp means mounted on the vertically stationary frame member of said forklift assembly for demountably pivotably connecting said forklift assembly to said hanger bracket at the upwardly and forwardly disposed end thereof;

(d) extensible power means mounted on the lower end of the vertically stationary frame member of said forklift assembly for demountable connection to said hanger bracket adjacent its point of attachment to the frame of the vehicle, said extensible power means actuatable to move said forklift assembly about its point of pivotal connection with said hanger bracket;

(e) load bearing means on said hanger bracket for supporting said forklift assembly when mounted on said hanger bracket; and (f) means on the vertically stationary frame member of said forklift assembly for movably engaging said load bearing means when said forklift assembly is mounted on said hanger bracket.

2. A material handling apparatus as claimed in claim 1 wherein said load bearing means comprises at least one arcuate rail affixed to said hanger bracket adjacent the lower and forwardly disposed portion thereof.

3. A material handling apparatus as claimed in claim 1 wherein said means on the vertically stationary frame member of said forklift assembly for movably engaging said load bearing means comprises at least one roller wheel.

4. A material handling apparatus as claimed in claim 1 wherein said extensible power means comprises a hydraulic cylinder pivotably mounted on the lower end of the vertically stationary frame member of said forklift assembly and having an extensible piston rod for demountable connection to said hanger bracket.

5. A material handling apparatus as claimed in claim 1 wherein said hanger bracket comprises:

(a) a spaced pair of side plates each having a substantially horizontally disposed portion for attachment to the front end of the frame of the automotive road vehicle so as to extend forwardly therefrom and each having a substantially vertically disposed portion integral with the forwardmost end of the horizontal portion and upstanding therefrom so as to extend upwardly in front of the automotive road vehicle when mounted thereon;

(b) an upper transverse crossbar mounted between the vertically disposed portions of said pair of side plates so as to be located substantially at the midpoint of the height dimension of the front end of the automotive road vehicle when said hanger bracket is mounted thereon, said upper transverse crossbar for receiving said releasable clamp means when said forklift assembly is demountably attached to said hanger bracket and serving as a pivot axis about which said forklift assembly is pivotably movable; and (c) a lower transverse crossbar connected between the horizontally disposed portions of said pair of side plates at the rearmost ends thereof, said lower transverse crossbar having said extensible power means demountably coupled thereto when said forklift assembly is demountably attached to said hanger bracket.

6. A material handling apparatus for demountable attachment to the front of an automotive road vehicle of the type having a frame for supporting a body, said material handling apparatus comprising:

(a) a hanger bracket for attachment to the frame of the automotive road vehicle, said hanger bracket including, I. a spaced pair of side plates each having a substantially horizontal portion attachable to the frame of the vehicle so as to extend forwardly therefrom, and each having a vertical portion integrally upstanding from the forward end of the horizontal portion thereof in front of the automotive vehicle when mounted thereon, II. an upper transverse crossbar mounted between the vertical portions of said side plates so as to be located substantially at the midpoint of the height dimension of the front end of the automotive road vehicle when said hanger bracket is mounted thereon, and III. a lower transverse crossbar mounted between the horizontal portions of said side plates at the rearmost ends thereof;

(b) a forklift assembly having a vertically stationary frame member disposed in a substantially upright position;

(c) releasable clamp means mounted on the vertically stationary frame member of said forklift assembly for pivotably demountably connecting said forklift assembly to said upper transverse crossbar of said hanger bracket;

(d) load bearing means mounted on each of said spaced pair of side plates of said hanger bracket for supporting said forklift assembly when mounted on said hanger bracket;

(e) roller wheel means mounted on the vertically stationary frame member of said forklift assembly for movably engaging said load bearing means when said forklift assembly is mounted on said hanger bracket; and (f) said forklift assembly having first and second vertically movable frame members telescopingly carried in the vertically stationary frame member thereof and having a carriage vertically movably mounted on the first stage vertically movable frame member with said carriage having a pair of forklift blades mounted thereon.

7. A material handling apparatus as claimed in claim 6 and further comprising:

(a) first extensible power means mounted on the lower end of the vertically stationary frame member of said forklift assembly for demountable connection to said lower transverse crossbar of said hanger bracket, said extensible power means actuatable to pivotably move said forklift assembly about said upper transverse crossbar when said forklift assembly is mounted on said hanger bracket; and (b) second extensible power means mounted on said forklift assembly for moving the first and second stage vertically movable frame members of said forklift assembly upon actuation thereof.

8. A material handling apparatus as claimed in claim 7 and further comprising power supply means mounted on the vertically stationary frame member of said forklift assembly and coupled to said first and said second extensible power means for selective actuation thereof.

9. A material handling apparatus as claimed in claim 6 and further comprising:

(a) a hydraulic cylinder mounted on the lower end of the vertically stationary frame member of said forklift assembly and having an extensible piston rod demountably connectable to said lower transverse crossbar of said hanger bracket, said first hydraulic cylinder actuatable to pivotably move said forklift assembly about said upper transverse crossbar when said forklift assembly is mounted on said hanger bracket; and (b) hydraulic cylinder means mounted on said forklift assembly for moving the first and second stage vertically movable frame members of said forklift assembly upon actuation thereof.

10. A material handling apparatus as claimed in claim 9 and further comprising a hydraulic power supply system mounted on the vertically stationary frame member of said forklift assembly and coupled to said hydraulic cylinder and to said hydraulic cylinder means for selective actuation thereof.

11. A material handling apparatus as claimed in claim 6 wherein each of said load bearing means comprises an arcuate rail mounted proximate the forwardly extending end of the horizontal portion of its respective one of said pair of side plates.

12. A material handling apparatus as claimed in claim 6 wherein the vertically stationary frame member and the first and second vertically movable frame members of said forklift assembly each have a height dimension which is less than the distance from the ground to the windshield of the automotive vehicle upon which said forklift assembly is demountably attachable.

* * * * *